US008226423B1

(12) United States Patent
Wu

(10) Patent No.: US 8,226,423 B1
(45) Date of Patent: Jul. 24, 2012

(54) ELECTRIC CONNECTOR HAVING A DEPLUGGING ASSISTANT DEVICE

(75) Inventor: Meng-Hsiu Wu, Taoyuan Hsien (TW)

(73) Assignee: Exito Electronics Co., Ltd, Taoyuan Hsien (TW)

( * ) Notice: Subject to any disclaimer, the term of this patent is extended or adjusted under 35 U.S.C. 154(b) by 0 days.

(21) Appl. No.: 13/087,315

(22) Filed: Apr. 14, 2011

(51) Int. Cl.
*H01R 13/62* (2006.01)

(52) U.S. Cl. ..... 439/160

(58) Field of Classification Search ..... 439/152, 439/159, 160, 131, 133, 139, 137, 346; 361/45, 361/42; 174/521
See application file for complete search history.

(56) References Cited

U.S. PATENT DOCUMENTS 4,678,254 A * 7/1987 Le Magourou ..... 439/139
5,862,029 A * 1/1999 Nicol ..... 361/42
6,122,155 A * 9/2000 Aromin et al. ..... 361/42
6,340,926 B1 * 1/2002 Chu ..... 337/407
6,913,475 B2 * 7/2005 Hsu ..... 439/160
7,074,060 B2 * 7/2006 Lee ..... 439/102
7,578,683 B2 * 8/2009 Zijlstra ..... 439/131
7,628,626 B1 * 12/2009 Tseng ..... 439/160
7,672,098 B2 * 3/2010 Zhang et al. ..... 361/42
7,946,873 B2 * 5/2011 Chen ..... 439/269.2
2006/0061924 A1 * 3/2006 Zhang ..... 361/42

* cited by examiner

*Primary Examiner* — Alexander Gilman

(57) ABSTRACT

An electric connector includes a connector body having conducting blades (or blade-insertion slots) located on the front side for the connection of a mating female (or male) electric connector and a plurality of tubular posts embedded in the back side, and a deplugging assistant device having a finger plate and shanks extended from the finger plate and respectively slidably coupled to the tubular posts of the connector body and movable relative to the tubular posts between a received position and an extended position. When the deplugging assistant device is in the extended position, the user can pull the finger plate to disconnect the electric connector from the mating female (or male) electric connector safely with less effort, avoiding an electric shock accident.

5 Claims, 10 Drawing Sheets

ELECTRIC CONNECTOR HAVING A DEPLUGGING ASSISTANT DEVICE

BACKGROUND OF THE INVENTION

1. Field of the Invention

The present invention relates to electric connectors and more particularly, to an electric connector having a deplugging assistant device that enables a user to deplug the electric connector easily and safely, avoiding an electric shock accident.

2. Description of the Related Art

An electric appliance generally uses an electric plug for connection to an electric outlet to obtain power supply. When deplugging an electric plug from an electric outlet, the user may encounter some problems as follows:

1. When the user is deplugging the electric plug from the electric outlet, the user must employ much effort to pull the housing of the electric plug in a direction perpendicularly away from the electric outlet. To an aged or disable person, it is difficult to pull the electric plug away from the electric outlet.

2. When deplugging the electric plug from the electric outlet, the user's fingers are kept close to the conducting blades of the electric plug and may touch the conducting blades accidentally before disconnection of the conducting blades from the electric outlet, causing an electric shock accident.

SUMMARY OF THE INVENTION

The present invention has been accomplished under the circumstances in view. It is the main object of the present invention to provide an electric connector having a deplugging assistant device that enables a user to easily and safely deplug the electric connector, avoiding an electric shock accident.

To achieve this and other objects of the present invention, an electric connector comprises a connector body having conducting blades (or blade-insertion slots) located on the front side for the connection of a mating female (or male) electric connector and a plurality of tubular posts embedded in the back side, and a deplugging assistant device having a finger plate and shanks extended from the finger plate and respectively slidably coupled to the tubular posts of the connector body and movable relative to the tubular posts between a received position and an extended position. Each shank comprises a tapered end block disposed at the distal end thereof and movable with the respective shank in the longitudinal sliding hole of the associating tubular post of the connector body, and a stop edge defined between the end block and the periphery of the respective shank and stoppable against the stop portions of the associating tubular post when each shank is moved relative to the associating tubular post to the extended position.

DETAILED DESCRIPTION OF THE PREFERRED EMBODIMENT

Referring to FIGS. 1~4, an electric connector in accordance with the present invention is shown comprising a body shell 1, a deplugging assistant device 2, a cover shell 3 and conducting blades 4. The cover shell 3 is formed integral with the periphery of the body shell 1 by a molding technique. The conducting blades 4 are fastened to the body shell 1 and extending out of one side, namely, the front side of the body shell 1 outside the cover shell 3.

Figure 1:
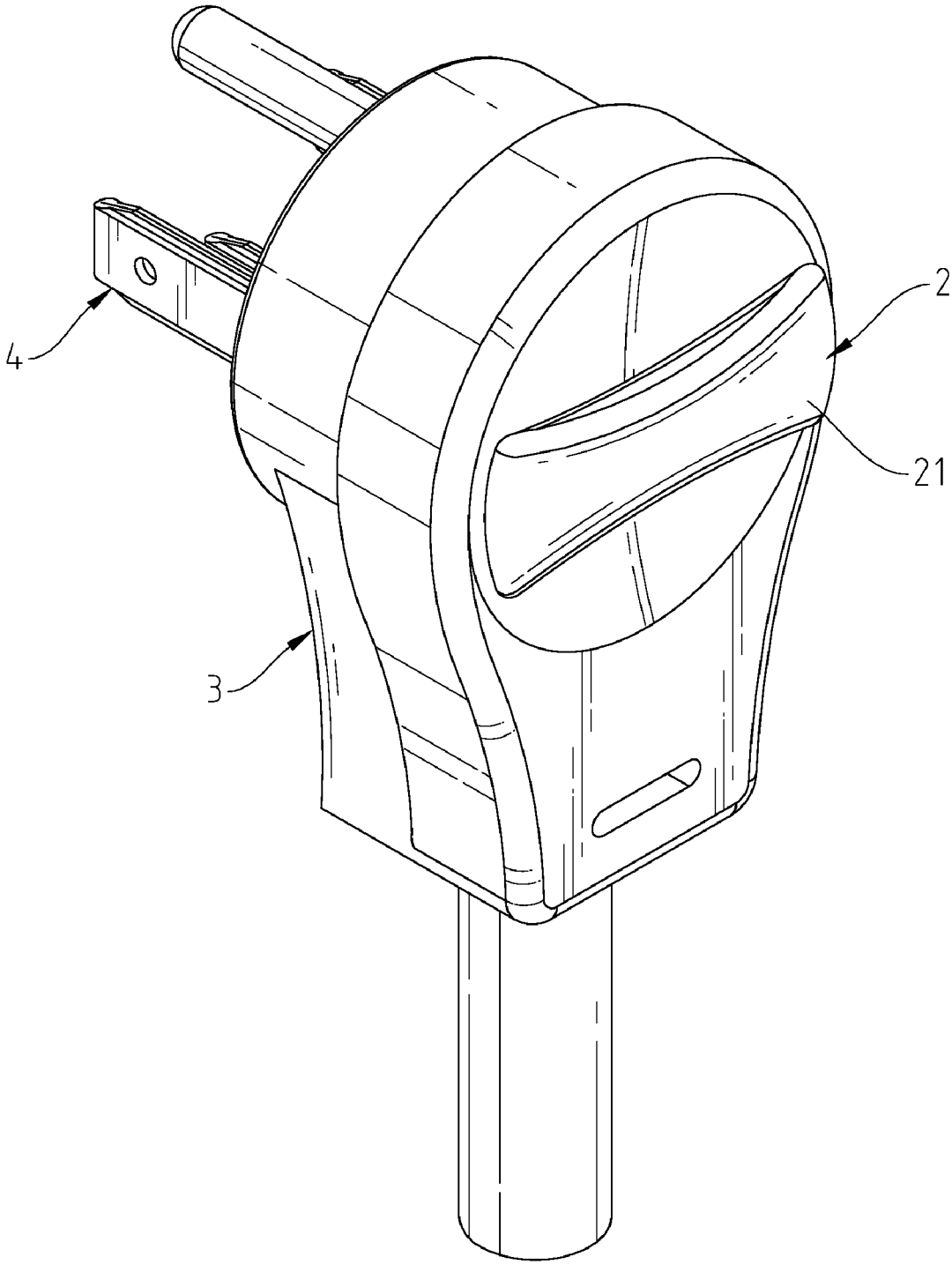
FIG. 1 is an elevational view of an electric connector in accordance with the present invention.
Figure 2:
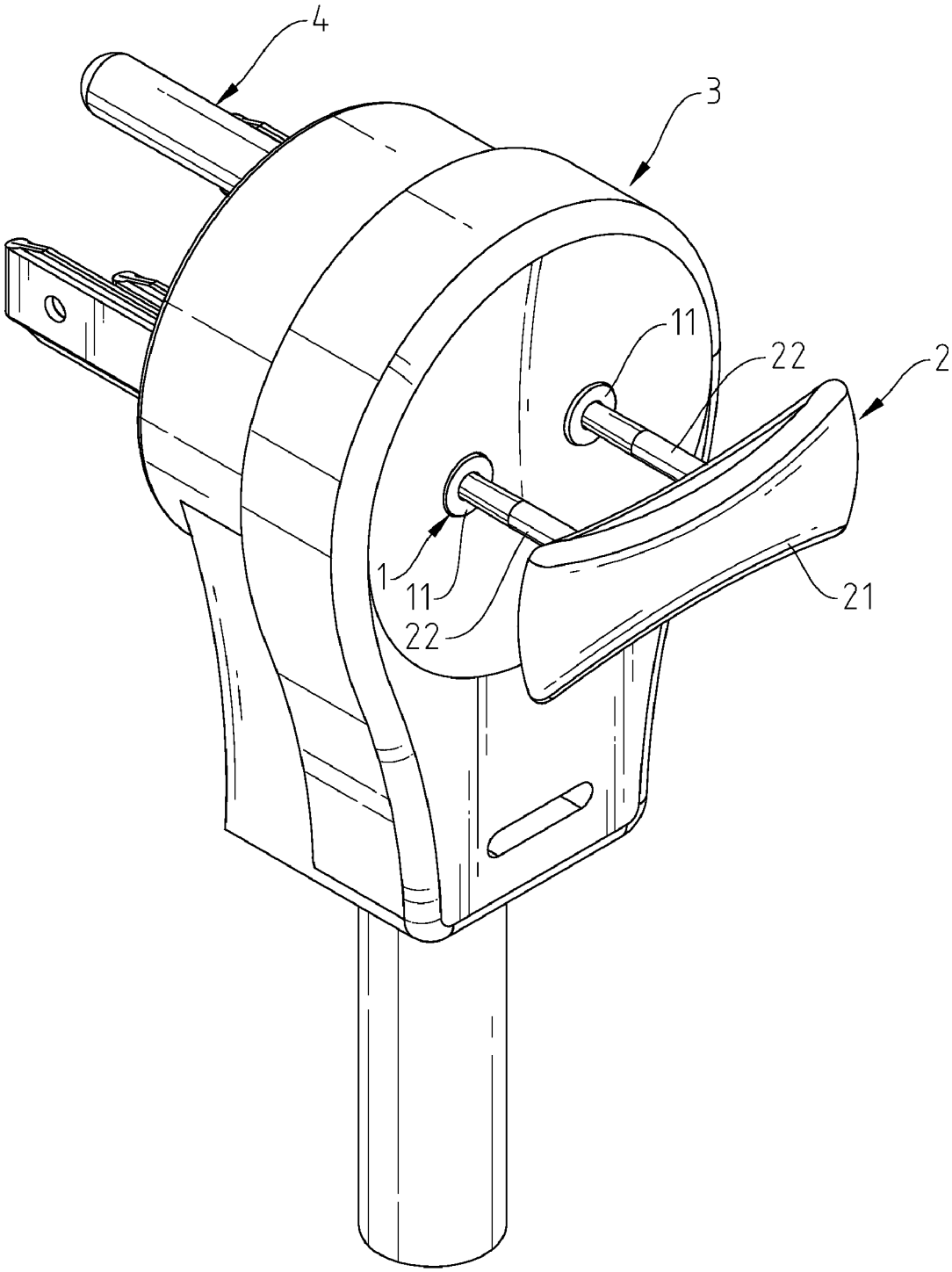
FIG. 2 corresponds to FIG. 1, illustrating the deplugging assistant device in the extended position.
Figure 3:
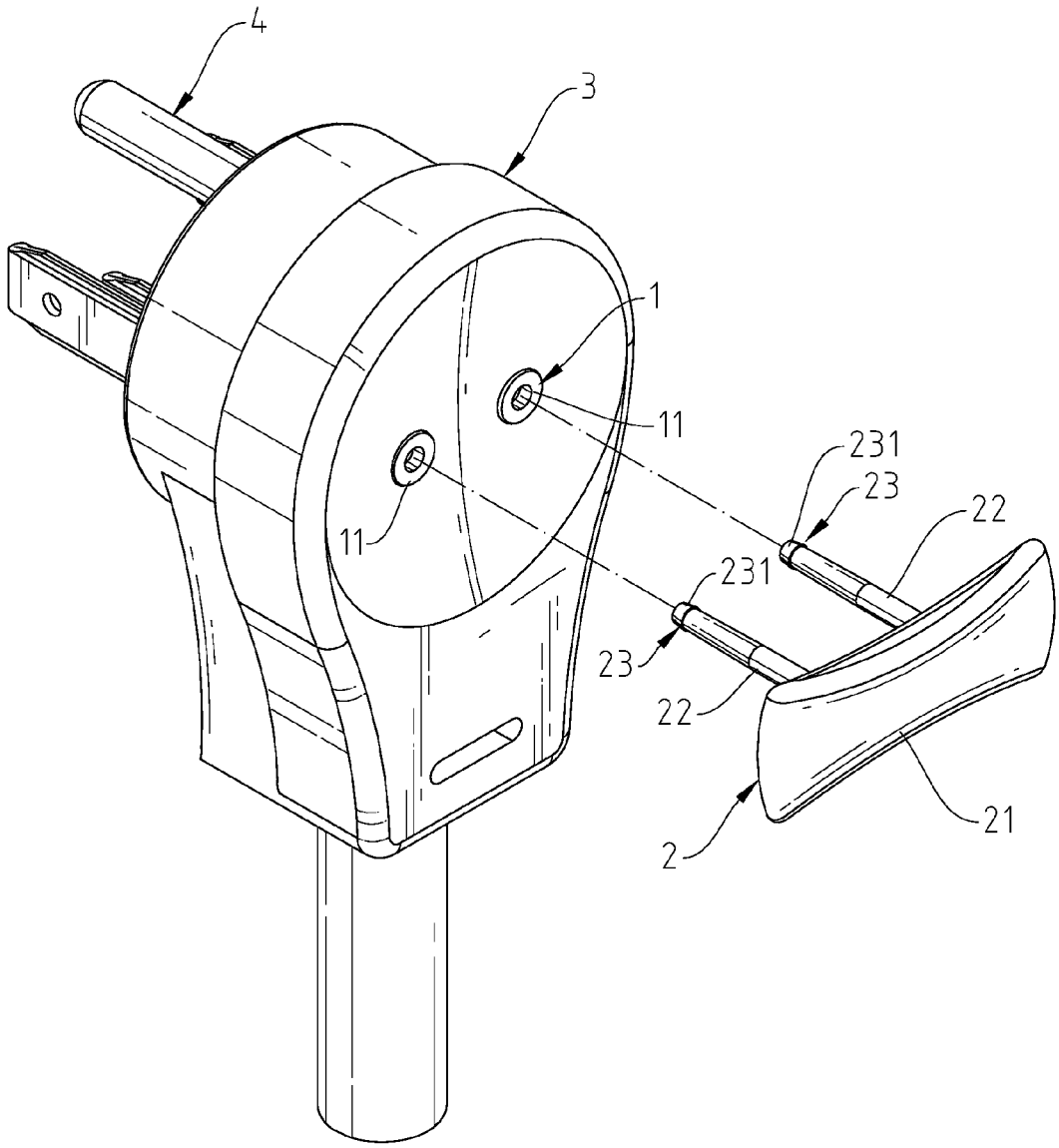
FIG. 3 is an exploded view of the electric connector in accordance with the present invention.
Figure 4:
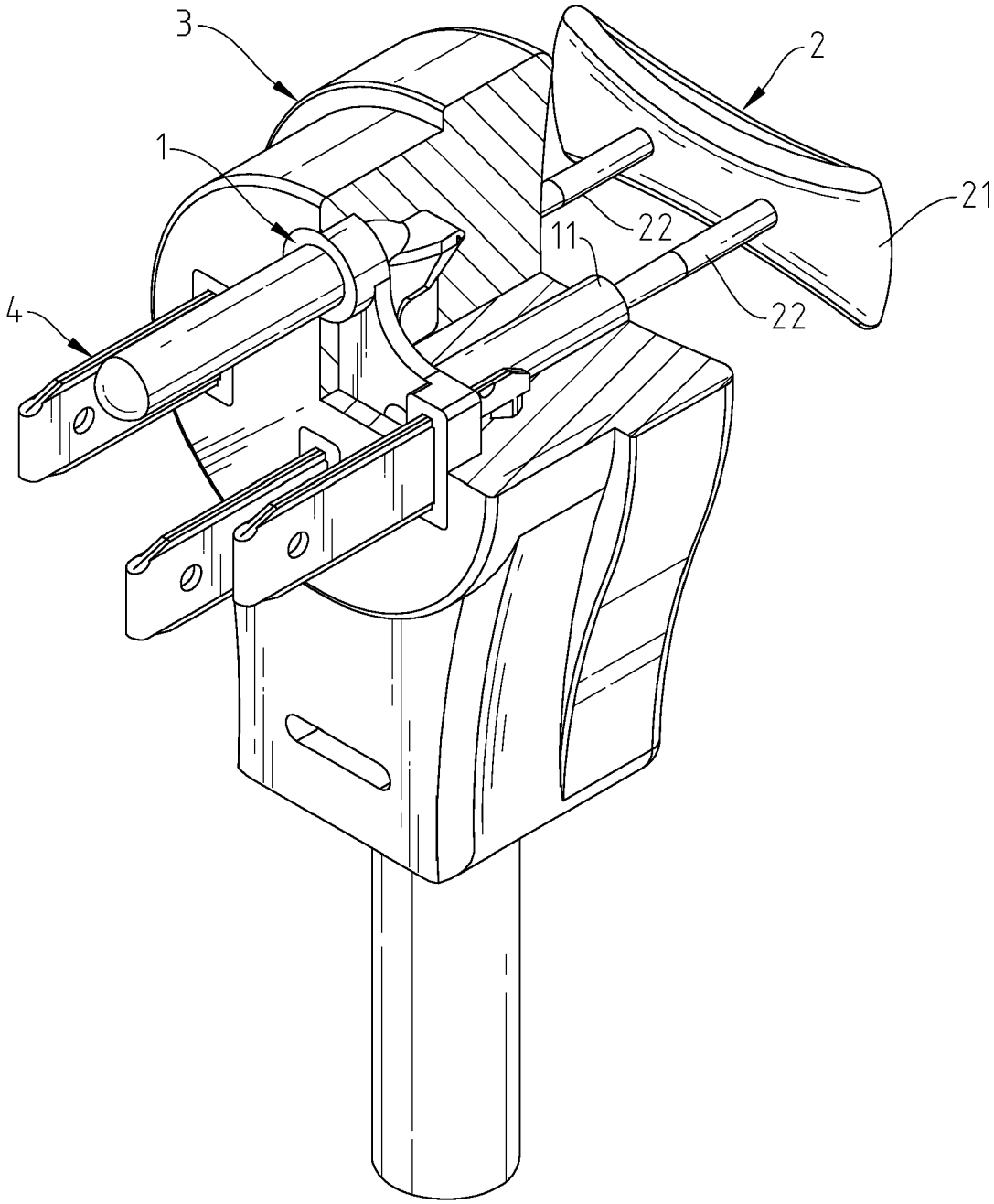
FIG. 4 is a cutaway view of the electric connector in accordance with the present invention.
Figure 5:
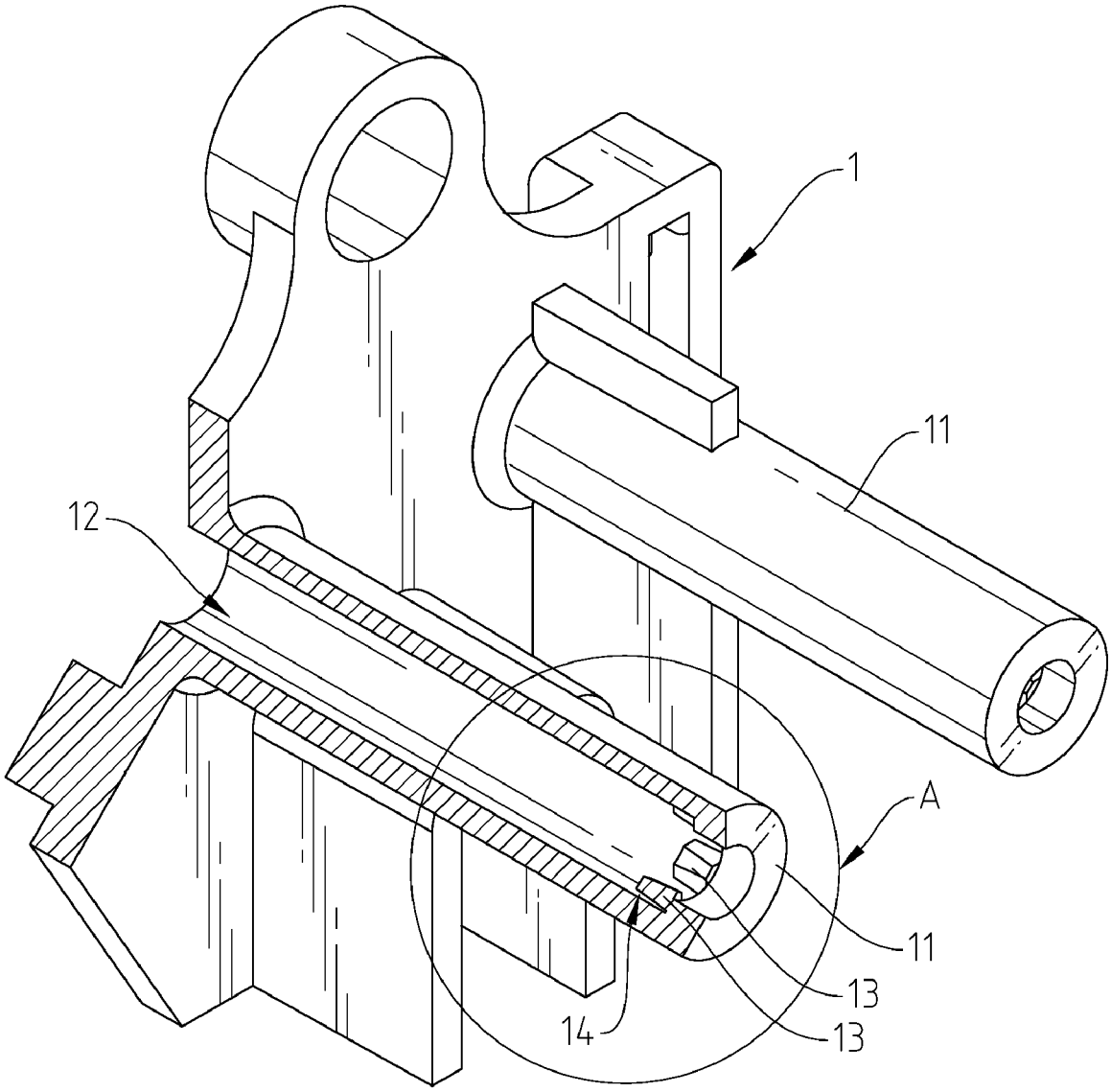
FIG. 5 is a sectional elevational view, in an enlarged scale, of a part of the body shell of the electric connector in accordance with the present invention.
Figure 6:
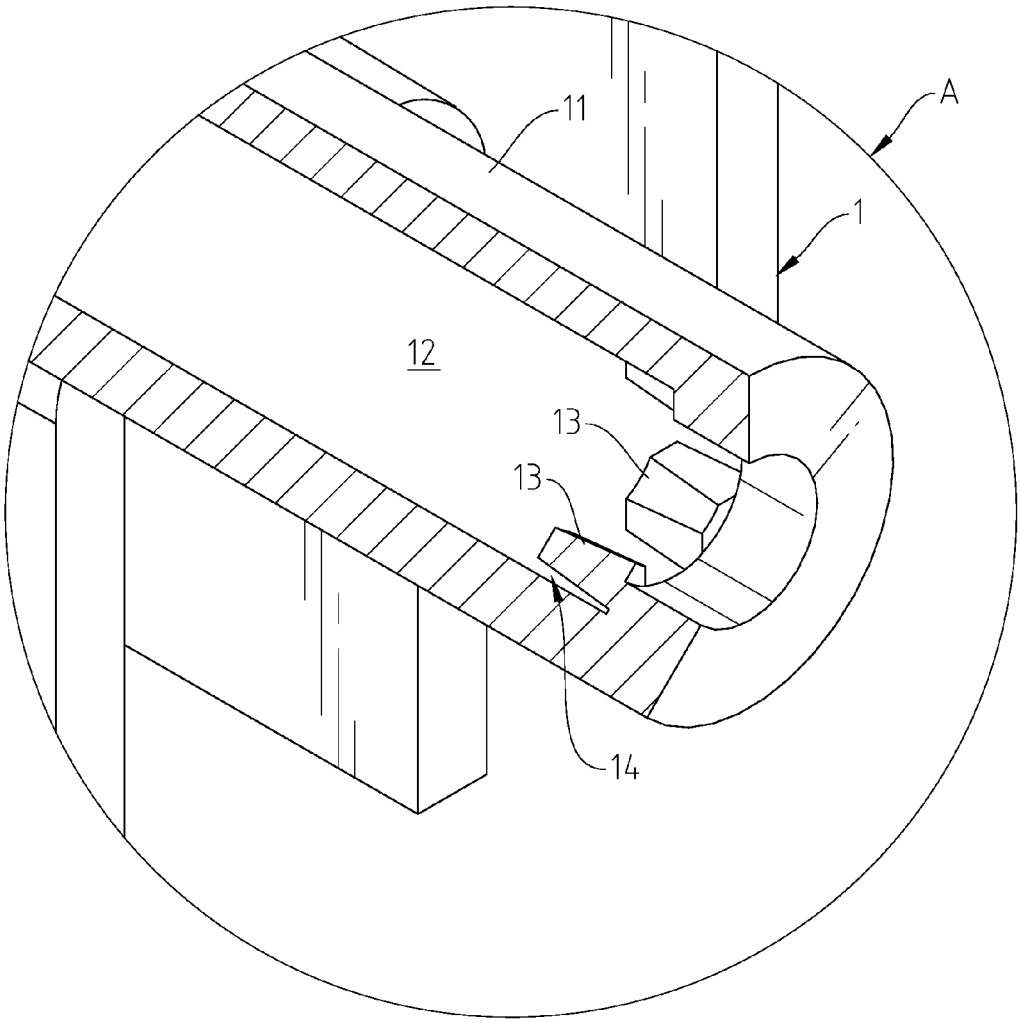
FIG. 6 is an enlarged view of Part A of FIG. 5.

The body shell 1, as shown in FIGS. 5 and 6, comprises a plurality of tubular posts 11 embedded in an opposite side, namely, the rear side of the body shell 1 and exposed to outside of the cover shell 3. Each tubular post 11 defines therein a longitudinal sliding hole 12, a plurality of stop portions 13 equiangularly spaced around the peripheral wall of the respective tubular post 11 at the distal end within the longitudinal sliding hole 12 and a displacement space 14 in between the peripheral wall of the respective tubular post 11 and the stop portions 13.

Figure 7:
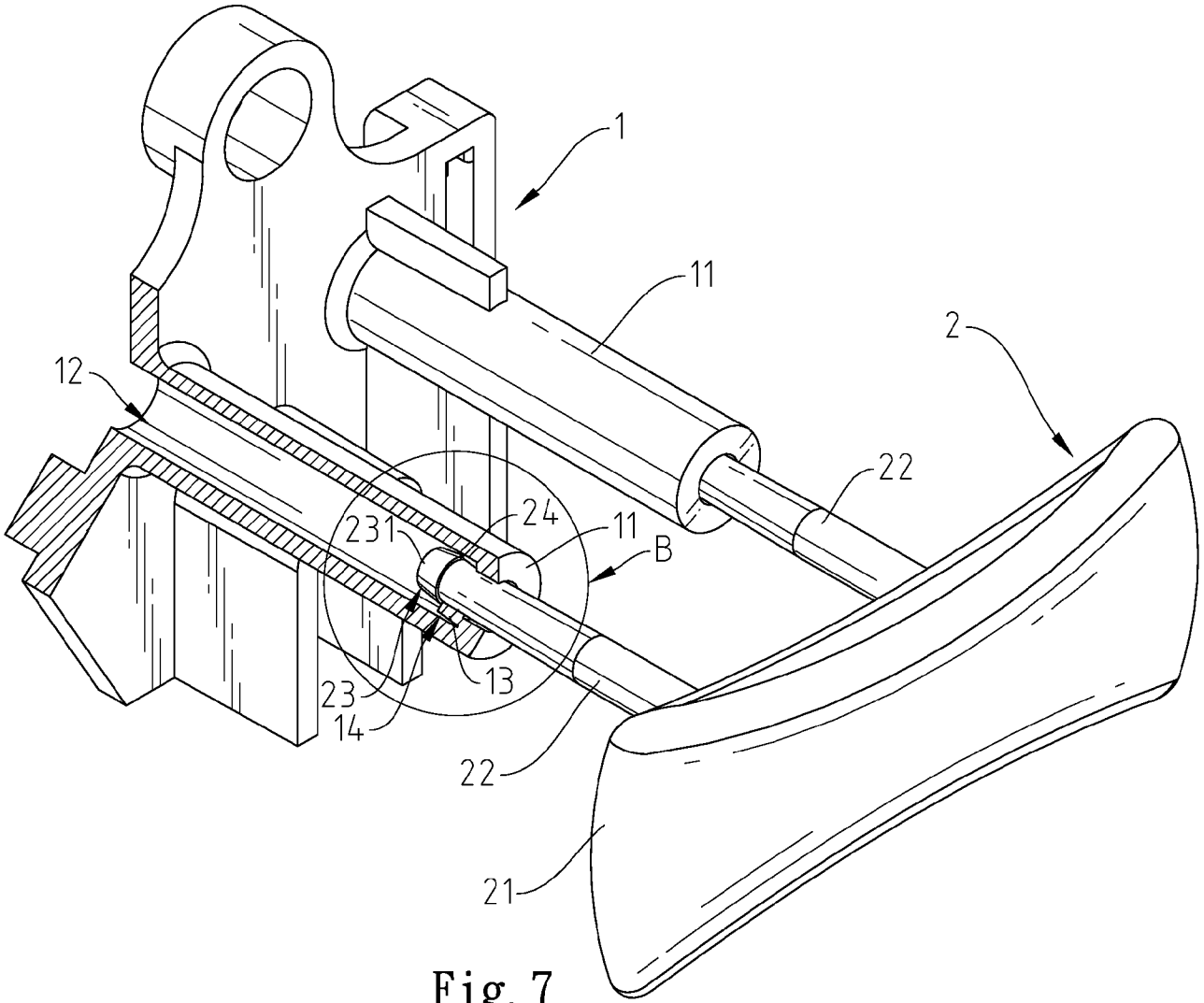
FIG. 7 is a sectional elevational view, in an enlarged scale, of a part of the present invention, illustrating the relationship between the end block of the shank and the stop portions of the associating tubular post of the body shell.
Figure 8:
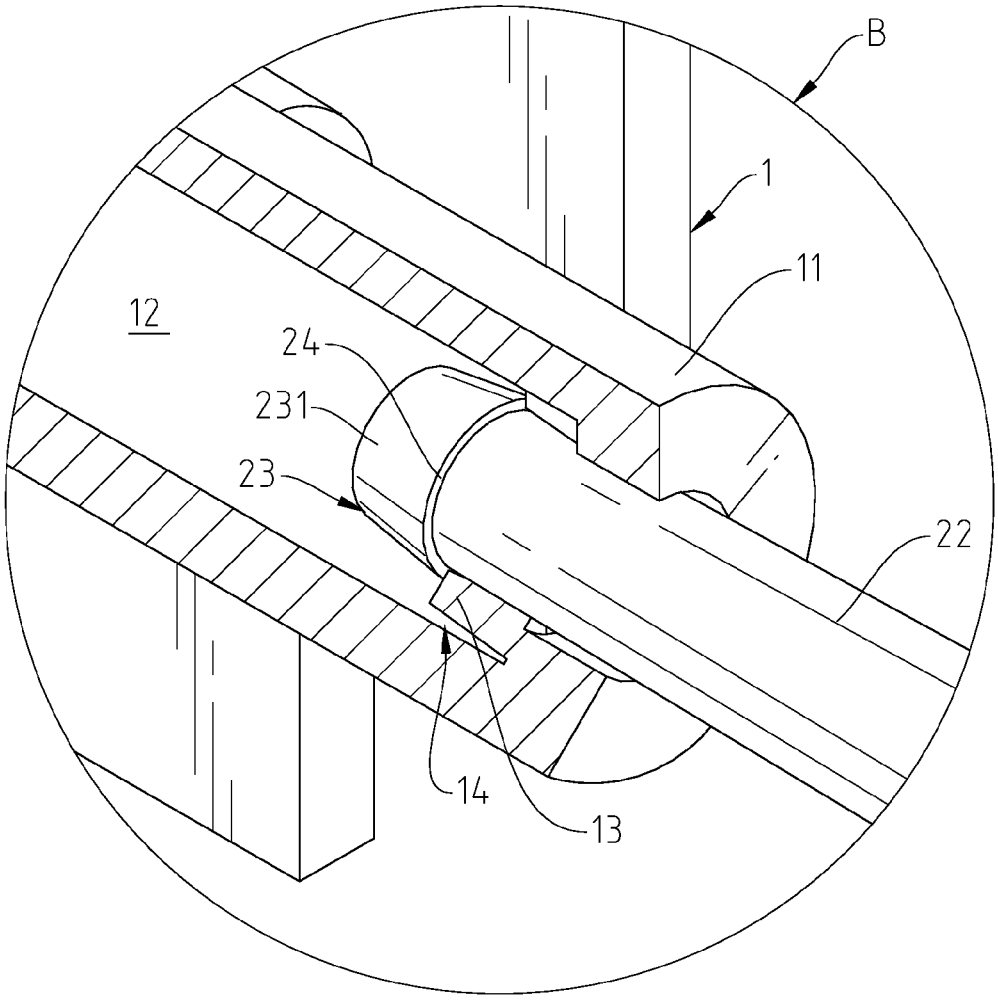
FIG. 8 is an enlarged view of Part B of FIG. 7.

The deplugging assistant device 2, as shown in FIGS. 7 and 8, comprises a finger plate 21, and a plurality of shanks 22 perpendicularly extended from one side, namely, the back side of the finger plate 21 for insertion into the tubular post 11 of the body shell 1 respectively. Each shank 22 has an end block 23 located on the distal end thereof remote from the finger plate 21. The end block 23 has a tapered peripheral wall 231. Further, a stop edge 24 is defined between the periphery of each shank 22 and the associating end block 23. The diameter of the tapered peripheral wall 231 reduces gradually in direction away from the shank 22. Further, the maximum diameter of the end block 23 of each shank 22 is greater than the diameter of the space surrounded by the stop portions 13 of each tubular post 11 of the body shell 1.

Referring to FIGS. 5~8 and FIGS. 3 and 4 again, when connecting the deplugging assistant device 2 to the body shell 1, insert the end blocks 23 of the shanks 22 into the tubular post 11 of the body shell 1 respectively. The tapered peripheral wall 231 of the end block 23 of each shank 22 facilitates the insertion of the end block 23 of respective shank 22 into the respective tubular post 11. When inserting the end block 23 of each shank 22 into the respective tubular post 11, the stop portions 13 of each tubular post 11 of the body shell 1 are forced radially outwardly toward the associating displacement space 14, and therefore the end block 23 of each shank 22 can easily be moved over the stop portions 13 into the longitudinal sliding hole 12 of the respective tubular post 11. After the end block 23 of each shank 22 is moved over the stop portions 13 into the longitudinal sliding hole 12 of the respective tubular post 11, the stop portions 13 immediately return to their former shape subject to their resilient material property. At this time, the stop portions 13 are kept in smooth contact with the periphery of the respective shank 22, allowing sliding movement of the respective shank 22 relative to the respective tubular post 11. When the shank 22 is pulled out of the respective tubular post 11, the stop edge 24 of the respective shank 22 will be stopped at the stop portions 13, avoiding disconnection of the shank 22 from the respective tubular post 11.

Figure 9:
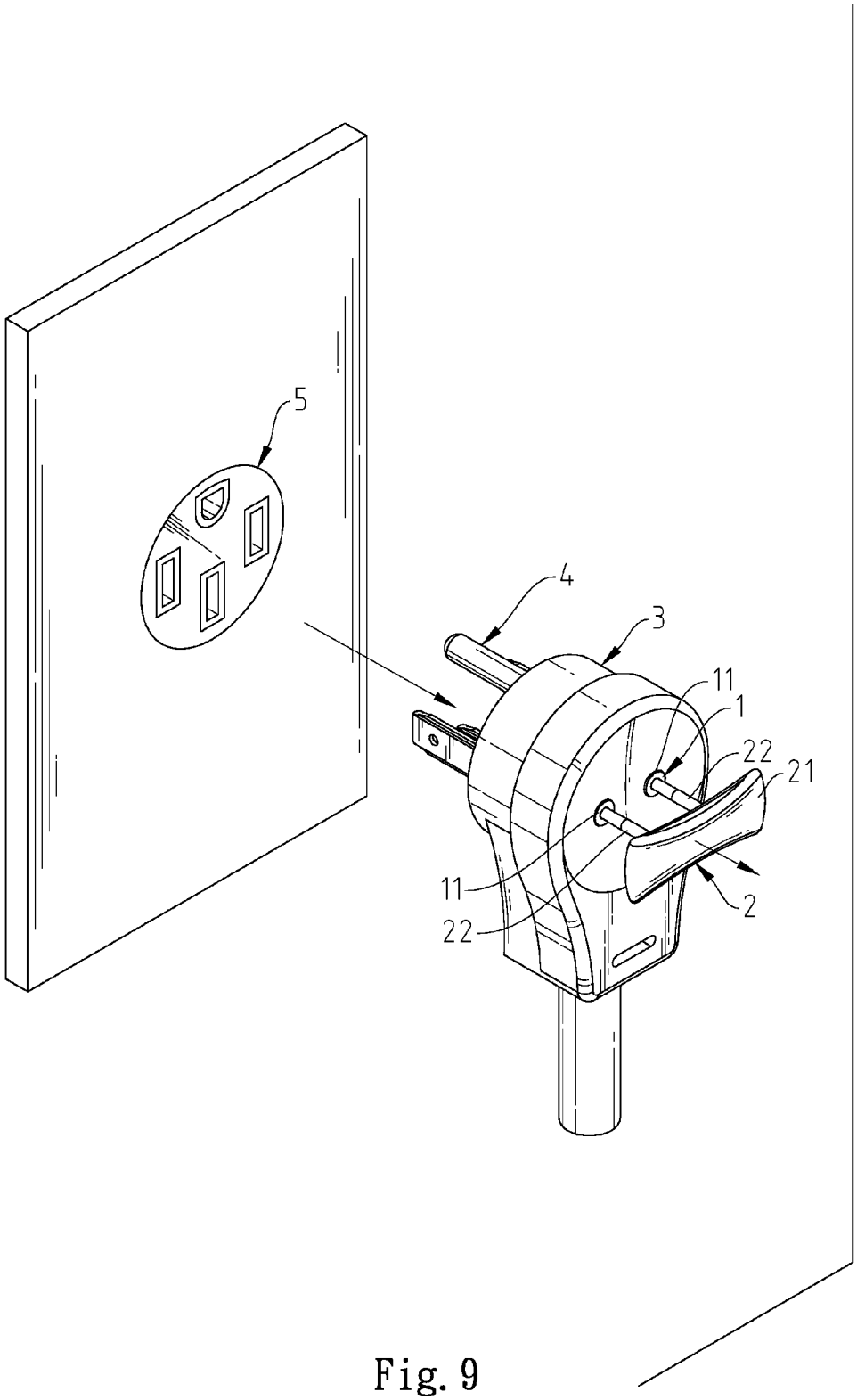
FIG. 9 is a schematic drawing illustrating an application example of the electric connector in accordance with the present invention.

Referring to FIG. 9 and FIGS. 3, 7 and 8 again, when wishing to deplug the electric connector from the mating electric socket 5, pull the finger plate 21 of the deplugging assistant device 2 in direction away from the cover shell 3 to carry the shanks 22 out of the respective tubular posts 11 and to let the stop edge 24 of each shank 22 be stopped at the stop portions 13 of the respective tubular post 11, and then insert the fingers into the gap between the finger plate 21 and the cover shell 3, and then pull the finger plate 21 outwardly to disconnect the conducting blades 4 from the mating electric socket 5.

Figure 10:
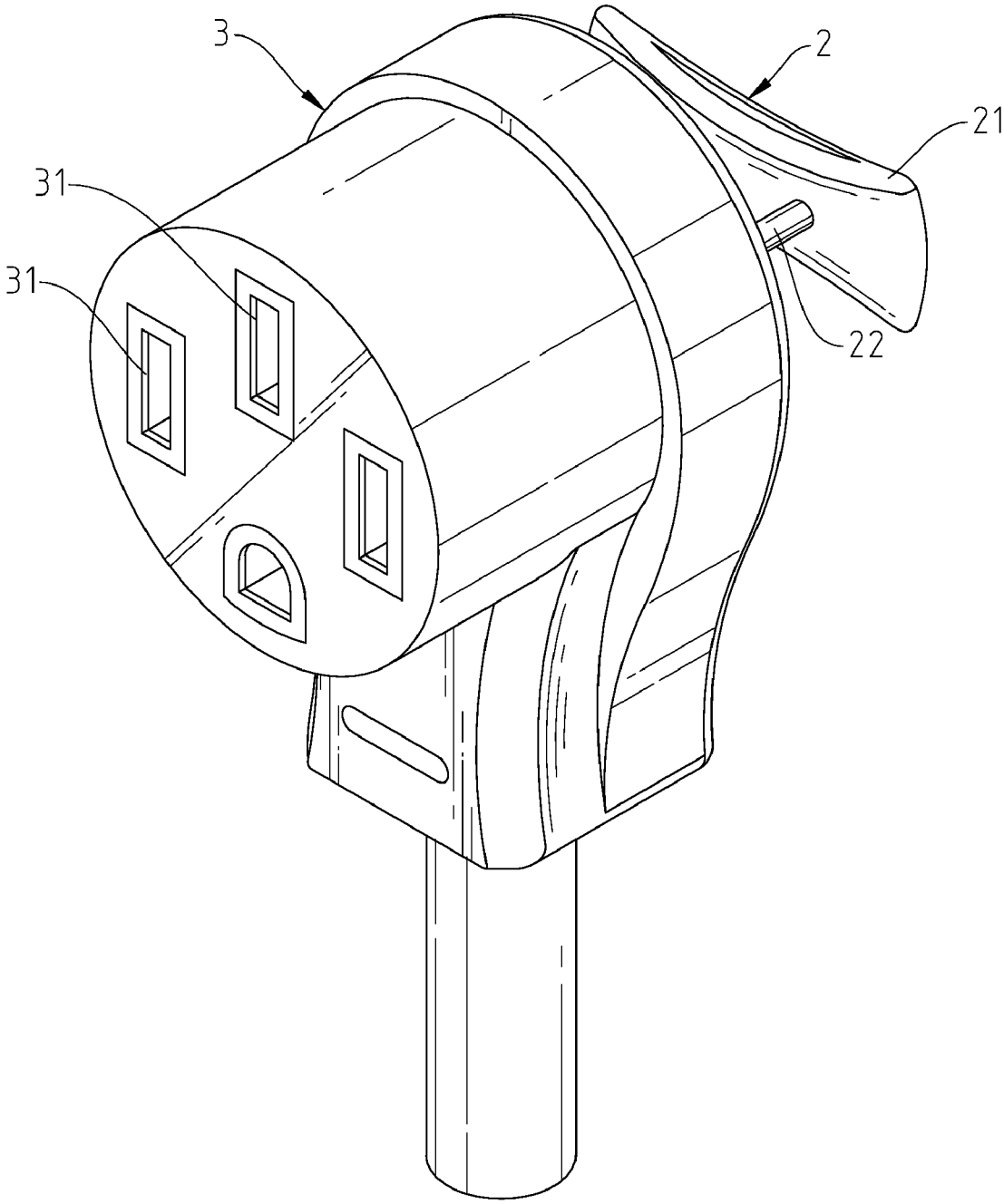
FIG. 10 is an oblique elevational view of an alternate form of the electric connector in accordance with the present invention.

FIG. 10 illustrates an alternate form of the electric connector in accordance with the present invention. According to this embodiment, the electric connector is an electric socket having slots 31 on the front side thereof for receiving the conducting blades and grounding prong of a mating electric plug, and electric contacts (not shown) respectively disposed in the slots 31 for the contact of the conducting blades and grounding prong of the inserted mating electric plug.

Referring to FIGS. 1 and 4 again, when the finger plate 21 is not in use, push the finger plate 21 to move the shanks 22 into the inside of the respective tubular posts 11 and to keep 21 is close contact with the cover shell 3.

In conclusion, the invention provides an electric connector equipped with a deplugging assistant device 2. When deplugging the electric connector, the user can move the finger plate 21 away from the cover shell 3 and then the finger plate 21 to disconnect the male (or female) electric connector from the mating female (or male electric connector easily with less effort. As the finger plate 21 is disposed at the back side of the body shell 1 and the cover shell 3 opposite to the conducting blades 4, the user's fingers will not touch the conducting blades 4 accidentally when deplugging the electric connector.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electric connector, comprising:

a connector body comprising a body shell, said body shell having opposing front side and rear side, a cover shell covered on and formed integral with said body shell, a plurality of electric contact means mounted in the front side of said body shell and at least one tubular post embedded in the rear side of said body shell, each said tubular post comprising a peripheral wall having a distal end exposed out of said cover shell, a longitudinal sliding hole surrounded by said peripheral wall, a plurality of stop portions equiangularly spaced within the distal end of said peripheral wall and a displacement space in between said peripheral wall of said stop portions; and a deplugging assistant device fastened to said body shell of said connector body to assist deplugging of said connector body from a mating electric connector, said deplugging assistant device comprising a finger plate and at least one shank perpendicularly extended from one side of said finger plate and respectively and axially slidably coupled to the longitudinal sliding hole of each of said at least one tubular post of said connector body and movable relative to said at least one tubular post between an extended position and a received position, each said shank comprising an end block disposed at a distal end thereof and movable with the respective shank in the longitudinal sliding hole of one said tubular post of said connector body and a stop edge defined between said end block and the periphery of the respective shank and stoppable against the stop portions of the associating tubular post when each said shank is moved relative to the associating tubular post to said extended position.

2. The electric connector as claimed in claim 1, wherein said connector body comprises a plurality of tubular posts arranged in parallel; said deplugging assistant device comprises a plurality of shanks respectively slidably coupled to the tubular posts of said connector body.

3. The electric connector as claimed in claim 1, wherein the end block of each said shank has a tapered peripheral wall.

4. The electric connector as claimed in claim 1, wherein said electric contacts are conducting blades fastened to said body shell and extending out of the front side of said body shell.

5. The electric connector as claimed in claim 1, wherein said body shell comprises a plurality of slots located on the front side thereof for the insertion of conducting blades of a mating electric plug; said electric contacts are respectively set inside said slots.

* * * * *